United States Patent [19]

Liuzzo

[11] 4,077,323

[45] Mar. 7, 1978

[54] DOCUMENT HOLDER

[75] Inventor: Christy N. Liuzzo, Phoenix, Ariz.

[73] Assignee: Valley National Bank, Phoenix, Ariz.

[21] Appl. No.: 802,792

[22] Filed: Jun. 2, 1977

Related U.S. Application Data

[63] Continuation-in-part of Ser. No. 683,046, May 5, 1976, abandoned.

[51] Int. Cl.[2] ..... B41F 3/50

[52] U.S. Cl. ..... 101/407 R; 101/269

[58] Field of Search ..... 101/269, 407 BP, 407 R, 101/407 A, 382 R; 40/159, 124.2, 64 R

[56] References Cited

U.S. PATENT DOCUMENTS

| | | | |
|---|---|---|---|
| 3,236,177 | 2/1966 | Perry, Jr. et al. | 101/269 |
| 3,358,596 | 12/1967 | Davis | 101/269 |
| 3,673,960 | 7/1972 | Ricci | 101/269 |

*Primary Examiner*—J. Reed Fisher

*Attorney, Agent, or Firm*—Cahill, Sutton & Thomas

[57] ABSTRACT

A document holder for use with identification card imprinters for holding a card carrying an embossed message and the document to be imprinted with the message in a fixed, predetermined relationship so that the message is imprinted at a predetermined location on the document. The document holder is dimensioned to fit standard embossed card imprinters.

3 Claims, 3 Drawing Figures

DOCUMENT HOLDER

This application is a continuation-in-part of Ser. No. 683,046, filed May 5, 1976, now abandoned.

BACKGROUND OF THE INVENTION

This invention relates to a document holder. More particularly, it relates to a document holder for use with imprinters such as are used in recording transactions by imprinting an embossed message onto a document.

In our near cashless society, more and more business transactions are made utilizing credit cards which carry an embossed message indentifying the holder of the card. Three items are required for each transaction — an embossed card, a record slip which records the transaction and receives an imprint of the message embossed on the card, and a printing machine for printing the embossed message on the record slip. The printing includes a printing station for receiving and holding the card and record slip during the printing operation. The card and slip are placed in a predetermined relative position, one overlapping the other, so that upon exertion of pressure from a printing platen on the embossed message, the message will be imprinted in an appropriate location on the slip. Certain types of cards and record slips must be held in different relative positions with respect to each other. Providing a special imprinting device to accommodate such cards and record slips is costly both in terms of machine cost and clerical inefficiency in operating two or more machines.

More recently, banks have issued check cashing cards which are quite similar in appearance to credit cards. The use of such check cashing cards enables a card holder to write a check directly on his checking account using a check form supplied by the commercial establishment where the check is being used to purchase merchandise. In those commercial establishments that have charge account systems of their own, it is common for them to have a credit card of different dimensions and charge slips of different layout than the check blanks issued by the banks. Further, the imprinters used by such commercial establishments are obviously intended specifically for their own charge cards and charge blanks. Therefore, to enable commercial establishments having their own charge card system to recognize check cashing cards issued by banks, it would ordinarily be necessary for the commercial establishment to purchase new imprinting devices to accommodate the bank card in view of its dimensional differences from their own charge cards. Since such commercial establishments are usually very large and usually utilize large numbers of imprinting devices, it has heretofore been uneconomical for them to recognize bank check cashing cards since it would require a substantial investment in hundreds or even thousands of new imprinting devices.

SUMMARY OF THE INVENTION

It is the principal object of this invention to provide a document holder positionable in the printing station of standard imprinting devices for holding an embossed card and record slip in relative position to one another so that the embossed message will be printed on the record slip in a predetermined location.

This and other objects which will become apparent hereinafter are provided by a document holder comprising a base having a major surface, pocket means mounted on the major surface, including an outer flap bonded to the major surface, the pocket means having an opening for receiving a card bearing an embossed message thereon, the pocket means further having an aperture in the outer flap, such aperture being located over the location of the embossed message when the card is inserted in said pocket, and receptacle means bonded to the major surface for positionably receiving a document to be imprinted with said message. The pocket means and receptacle means are positioned with respect to each other such that the document overlaps the pocket aperture so that the message is positioned underneath a predetermined location on the document.

BRIEF DESCRIPTION OF THE DRAWINGS

Referring to FIGS. 1–3, the document holder 10 includes a rectangularly-shaped, flat base 12 to which is bonded a rectangular flap 14 and a flap 16. Base 12 is made of a relatively thick, stiff material to provide a firm, resistive, unyielding backing to permit the embossed message to be properly printed on the record slip. The stiff material used for the base 12 is formed of conventional plastic material of the type generally utilized in typical plastic credit cards. However, since the base 12 will normally be of substantially larger area than a credit card, the thickness of the base 12 may be increased somewhat to provide the necessary stiffness. Flap 14 is bonded along lateral edges 18 and 20 and bottom edge 22 to base 12 to provide a pocket 24 dimensioned to receive a card 26 bearing an embossed message 28 in the form of a series of numbers identifying the card owner. Flap 14 has an aperture 30 positioned and dimensioned so that embossed message 28 is uncovered. Edge 32 of flap 14 is not bonded to base 12, thereby providing an opening 34 for insertion of card 26 into pocket 24. Edge 36 of base 12 has a notch 38 to enable card 26 to be easily grasped for removal from pocket 24. Opening 34 extends parallel to edge 36 to permit insertion of the card from the top of holder 10.

Figure 1:
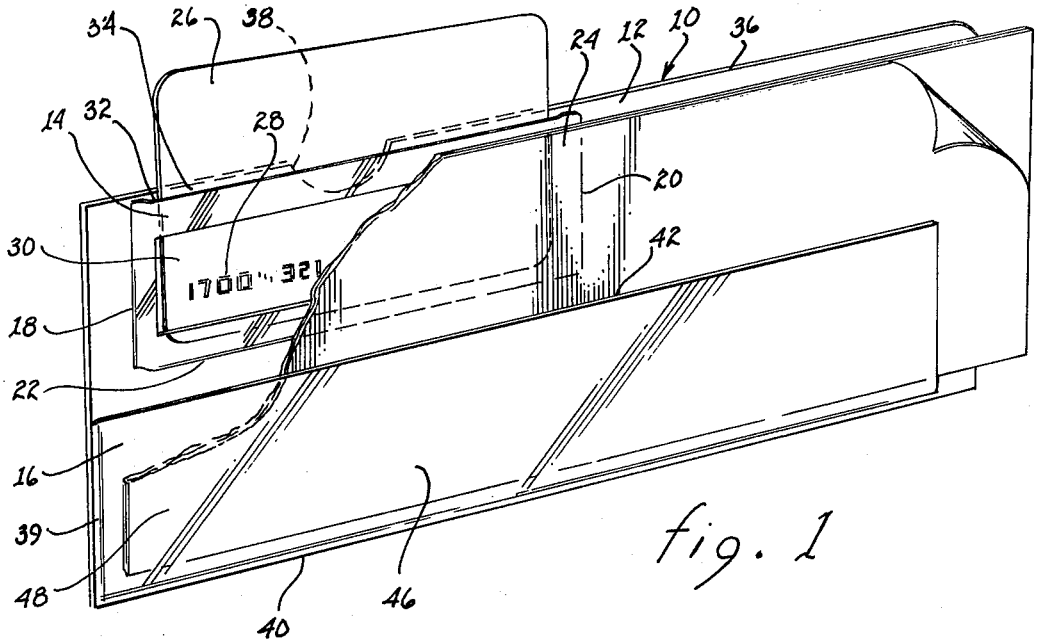
FIG. 1 is a perspective view of the document holder of this invention with the card and record slip in position.
Figure 2:
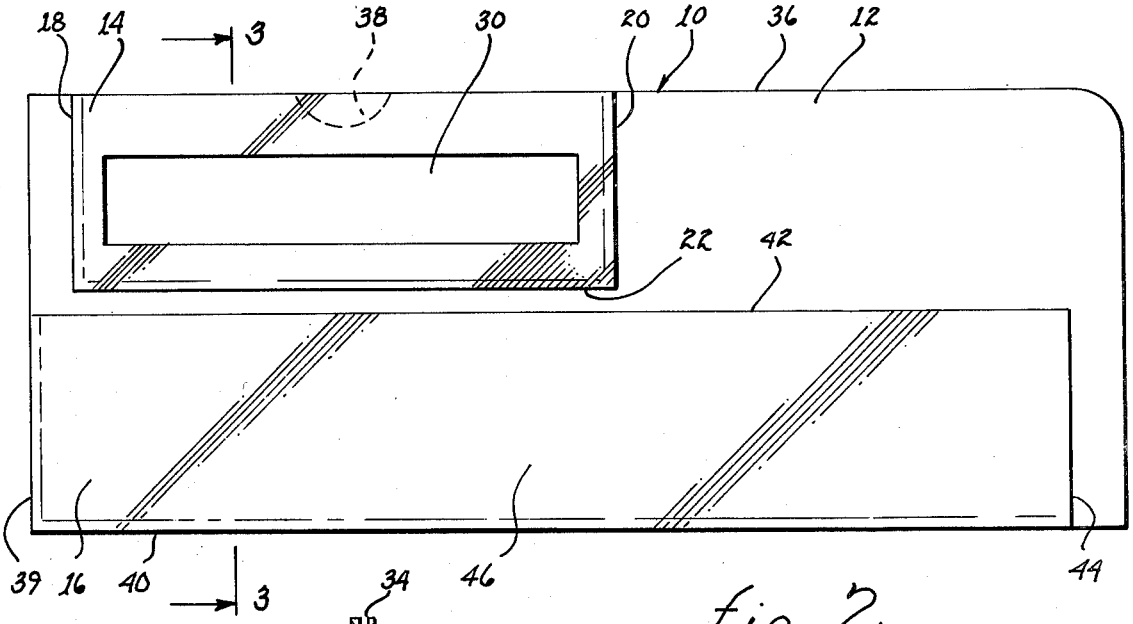
FIG. 2 is a front plan view of the document holder of FIG. 1.
Figure 3:
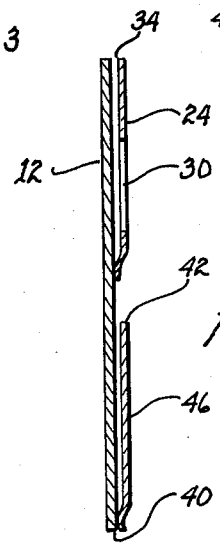
FIG. 3 is a view taken along line 3—3 of FIG. 2.

Flap 16 is bonded to base 12 only along edges 39 and 40. Edges 42 and 44 of flap 16 are free providing a receptacle 46 for record slip 48. Record slip 48 may be a single sheet or a plurality of sheets with carbons suitably located. The openings provided by unbonded edges 42 and 44 allow the record slip 48 to be positioned in overlapping relationship to the portion of the card 24 bearing embossed message 28. Record slip 48 extends beyond the edge 44 of flap 16. By having edges 42 and 44 free, receptacle 46 can accommodate various sized record slips.

The flap 14, bonded to the base 12 to provide the pocket 24, is formed of conventional flexible plastic material of a type conventionally found in wallets, purses, and the like, for holding driver's licenses, photographs, and credit cards. The material of the flap 14 need not be transparent or even translucent since its only function is to temporarily receive the card 26 and hold the card in an appropriate position relative to the record slip 48. The flap 16 may be constructed of material similar to that of flap 14. That is, a flexible plastic material that is bondable along edges 39 and 40 to the base 12 and which will readily flex to admit the record slip 48 between the flap 16 and the base 12.

In operation, the card 26 is inserted in pocket 24 with the embossed message 28 facing up, away from base 12, and within borders of aperture 30. Record slip 48 is then positioned in receptacle 46 so that the portion of the record slip 48 to receive the imprinted message overlies embossed message 28. The document holder 12 is then placed in the printing station of the imprinter device, and the platen impressed against the portion of the record slip 48 to receive the imprinted message. The imprinter device may be of any standard design utilizing either a hinged or rolling platen. Indeed, the imprinter device need not even be a standard imprinter and may be formed simply of a hard roller of some kind that is rolled over the embossed message 28 and the record slip 48. For example, a hand-held wooden or hard plastic roller may be used in those instances where a conventional imprinter device is not available. In such environments as door-to-door sales, or sales made by a representative away from the commercial establishment, the device of the present invention provides a means for the customer to use his charge card or bank checking card without the requirement that the salesman carry a bulky and heavy imprinter device.

The device of the present invention is flat, unobstructed and free from tabs or extensions that are frequently required for maintaining registration of the combined charge card and record slip in a particular imprinting device; the device of the present invention is thereby readily transported or stored behind a counter, in a catalog, or even in a pocket of a salesman, and is truly universal in application.

I claim:

1. A document holder for use with an identification card imprinter for holding a card carrying on embossed message and the document to imprinted with the message in a fixed, predetermined relationship so that the message is imprinted at a predetermined location on the document; said document holder comprising:

(a) a flat base member having at least one smooth relatively hard face major surface;

(b) a rectangular, flexible flap bonded along three edges thereof to said base member to form a pocket for receiving a card between said flap and said base, said card bearing an embossed message thereon;

(c) said pocket having an aperture positioned over the location of said embossed message when said card is inserted in said pocket;

(d) a second flexible flap bonded along two edges thereof to said base to form a receptacle between said flap and said base for receiving a document to be imprinted with said message; and (e) said pocket and said receptacle being positioned with respect to each other such that said document overlaps said aperture whereby said message is positioned underneath a predetermined location on said document; whereby, said base member retains the credit card and document and provides a supporting surface for imprinting the document by operation of the card imprinter.

2. The document holder of claim 1 wherein said pocket is formed by bonding said rectangular flexible flap along three edges thereof to said base member and the fourth edge of said rectangular flexible flap is unbonded and coincident with an edge of said base member.

3. The document holder of claim 1 wherein said second flexible flap is rectangular and is bonded along two edges to said base, the two remaining edges of said second flexible flap remaining unbonded to permit the insertion of a document between said second flexible flap and said base.

* * * * *